United States Patent [19]

Kucuk et al.

[11] Patent Number: 4,799,157

[45] Date of Patent: Jan. 17, 1989

[54] METHOD FOR UNIQUELY ESTIMATING PERMEABILITY AND SKIN FACTOR FOR AT LEAST TWO LAYERS OF A RESERVOIR

[75] Inventors: Fikri Kucuk; Luis C. Ayestaran, both of Houston, Tex.

[73] Assignee: Schlumberger Technology Corporation, Houston, Tex.

[21] Appl. No.: 62,324

[22] Filed: Jun. 9, 1987

Related U.S. Application Data

[63] Continuation of Ser. No. 648,113, Sep. 7, 1984, abandoned.

[51] Int. Cl.[4] ..... E21B 47/00; G01F 13/00

[52] U.S. Cl. ..... 364/422; 73/155

[58] Field of Search ..... 364/420, 421, 422; 367/31, 75; 73/9, 89, 155

[56] References Cited

U.S. PATENT DOCUMENTS

| | | | |
|---|---|---|---|
| 3,771,360 | 11/1973 | Prats | 73/155 |
| 3,896,413 | 7/1975 | Dowling et al. | 367/25 |
| 3,900,826 | 8/1975 | Dowling et al. | 367/31 |
| 4,043,112 | 8/1977 | Shuck | 73/155 |
| 4,245,313 | 1/1981 | Coates | 364/422 X |
| 4,328,705 | 5/1982 | Gringaiten | 73/155 |
| 4,398,416 | 1/1984 | Bostic, III et al. | 73/155 |
| 4,400,970 | 8/1983 | Ali | 73/9 |
| 4,420,975 | 12/1983 | Nagel | 73/155 |
| 4,423,625 | 8/1983 | Nolte | 73/155 |
| 4,554,819 | 11/1985 | Ali | 73/9 |
| 4,575,828 | 3/1986 | Williams | 367/31 |
| 4,742,459 | 5/1988 | Lasseter | 364/422 |
| 4,995,805 | 1/1955 | Dowling et al. | 73/155 |

OTHER PUBLICATIONS

H. C. Lefkovits, P. Hazebroek, E. E. Allen and C. S. Matthews "A Study of the Behavior of Bonded Reservoirs Composed of Stratified Layers" Soc. Pet. Eng. J. (Mar. 1961) 43–58.

Kucuk and Ayestaran, "Analysis of Simultaneously Measured Pressure and Sandface Rate in Transient Well Testing" SPE 12177, 1983.

*Primary Examiner*—Jerry Smith

*Assistant Examiner*—Charles B. Meyer

*Attorney, Agent, or Firm*—Henry N. Garrana; John H. Bouchard

[57] ABSTRACT

A method for layered reservoirs without crossflow in order to estimate individual layer permeabilities and skin factors is disclosed. The method consists of two sequential drawdown tests. During these tests the wellbore pressure and the sandface flow must be measured simultaneously. The permeability and skin factor for each layer are estimated uniquely using measured wellbore pressure and sandface flow rate from these two drawdown tests. The method can be generalized straightforwardly to layered reservoirs with crossflow, and can also be used to estimate skin factors for each perforated interval in a single layer reservoir.

4 Claims, 4 Drawing Sheets

METHOD FOR UNIQUELY ESTIMATING PERMEABILITY AND SKIN FACTOR FOR AT LEAST TWO LAYERS OF A RESERVOIR

This is a continuation of application Ser. No. 648,113 filed Sept. 7, 1984 and now abandoned.

BACKGROUND OF THE INVENTION

1. Field of the Invention

The invention relates to well testing in general and in particular to a method for downhole measurements and recording of data from a multiple layered formation of an oil and gas well and for estimating individual permeabilities and skin factors of the layers using the recorded data.

2. Description of the Prior Art

The estimation of parameters of stratified layers without crossflow of an oil and gas well is not a new problem. Over the years, many authors have investigated the behavior of layered reservoirs without cross flow. Much work has been done on estimating parameters of layered reservoirs because they naturally result during the process of sedimentation. Layered reservoirs are composed of two or more layers with different formation and fluid characteristics.

One of the major problems for layered reservoirs is the definition of the layers. It has been found that it is essential to integrate all logs and pressure transient and flowmeter data in order to determine flow capacities, skin factors, and the pressure of individual layers. This invention relates primarily to two-layer reservoirs with a flow barrier between the layers (without crossflow). The production is commingled at the wellbore only.

During a buildup test, fluid may flow from the high pressure zone to the low pressure zone through the wellbore as a result of a differential depletion. The crossflow problem becomes more severe if the drainage radius of each zone is different. Wellbore crossflow could occur while the pressure is building up. A straight line may be observed on the Horner plot. This behavior has been observed many times in North Sea reservoirs.

The crossflow problem has been overlooked by the prior art because in many instances the pressure data itself does not reveal any information about the wellbore crossflow. Furthermore, the end of the wellbore crossflow between the layers cannot be determined either quantitatively or qualitatively. If fluid segregation in the tubing and wellbore geometry is added to the complication mentioned above, the buildup tests from even two-layer reservoirs without crossflow cannot easily be nalyzed.

This invention relates to the behavior of a well in an infinite two-layered reservoir. If the well has a well-defined drainage boundary (symmetric about the well axis for both layers), and if a well test is run long enough, the prior art has shown that it is possible to estimate the individual layer permeabilities and an average skin. However, cost or operational restrictions can make it impractical to carry out a test of sufficient duration to attain a pseudo steady-state period. Moreover, even if the test is run long enough, an analyzable pseudo steady-state period may not result because of non-symmetric or irregular drainage boundaries for each layer. It is also difficult to maintain a constant production rate long enough to reach a pseudo steady-state period.

A major problem for layered systems not addressed by the prior art is how to estimate layer permeabilities, skins, and pressures from conventional well testing. In practice, the conventional tests (drawdown and/or buildup) only reveal the behavior of a two-layer formation which cannot be distinguished from the behavior of a single-layer formation even though a two-layer reservoir has a distinct behavior without wellbore storage effect. There are, of course, a few special cases for which the conventional tests will work.

The effect of wellbore storage on the behavior of the layered reservoirs is more complex than that of single-layer reservoirs. First, the wellbore storage may vary according to the differences in flow contribution of each layer. Second, it has been observed that it takes longer to reach the semilog straight line than that of the equivalent single-layer systems.

It is important for the operator of an oil and gas well having a multiple layer reservoir to be able to determine the skin factor, s, and the permeability, k, of each layer of the formation. Such information aids the operator in his determination of which zone may need reperforation or acidizing. Such information may also aid the operator to determine whether loss of well production is caused by damage to one layer or more layers (high skin factor) as distinguished from other reasons such as gas saturation buildup. Reperforation or acidizing may cure damage to the well while it will be useless for a gas saturation buildup problem.

IDENTIFICATION OF OBJECTS OF THE INVENTION

It is a general object of the invention to provide a well test method to estimate multi-layered reservoir parameters.

It is a more specific object of the invention to provide a well test method to estimate uniquely the permeability k and the skin factor s for each layer in a multiple layer reservoir.

SUMMARY OF THE INVENTION

According to the invention, a well test method for uniquely estimating permeability and skin factor for each of at least two layers of a reservoir includes the positioning of a logging tool of a logging system at the top of the upper layer of a wellbore which traverses the two layers. The logging system has means for measuring downhole fluid flow rate and pressure as a function of time. The surfaceflow rate of the well is changed from an initial surface flow rate at an initial time, $t_1$, to a different surface flow rate at a subsequent time, t2, during a first time interval, t1 to t2. The downhole fluid flow rate, $q_1(t)$, and downhole pressure $p_1(t)$, are measured and recorded during the first time interval, $t_1$ to $t_2$, at the top of the upper layer.

The logging tool is then positioned to the top of the lower layer where the downhole flow rate, $q_{12}$, from the top of the lower layer is measured and recorded if possible at a stabilized flow. The surface flow rate is then changed at time $t_3$, to another flow rate during a time interval t3 to t4. The downhole fluid flow rate, $q_{22}(t)$, and downhole pressure, $p_2(t)$, are measured and recorded during the second interval, $t_3$ to $t_4$, at the top of the lower layer.

The functions $\bar{k}$ and $\bar{s}$ are determined, where $$\bar{k}=(k_1h_1+k_2h_2)/h_t$$

$$h_t=h_1+h_2$$

$$\bar{s}=(q_{11}(t_2)s_1+q_{12}(t_2)s_2)/q_1(t_2)$$

where $k_1$ = permeability of upper layer
$k_2$ = permeability of lower layer
$h_1$ = known thickness of upper layer
$h_2$ = known thickness of lower layer $$q_{11}(t_2)=q_1(t_2)-q_{12}(t_2),$$

by matching the measured change in downhole pressure, $p_1(t)$, with the convolution of the measured fluid flow rate $q_1(t)$ and an influence function $\Delta p_{sf}(t)$ which is a function of combined-layered permeability, $\bar{k}$, and skin effect $\bar{s}$.

The permeability, $k_2$, of the lower layer and the skin factor, $s_2$, of the lower layer are determined by matching the measured fluid flow rate, $q_{22}(t)$, with the convolution of the measured change in downhole pressure, $\Delta p_2(t)=p_1(t_3)-p_2(t)$, and an influence function, f(t), which is a function of the lower layer permeability, $k_2$, and skin factor, $s_2$. The parameters $k_1$ and $s_1$ for the first layer are determined from estimates of $k_2$, $s_2$ and $\bar{k}$ and $\bar{s}$.

Testing regimes are defined for non-flowing wells and for flowing wells. Estimation methods are presented for matching measured values of pressure and flow rate with calculated values, where the calculated value changes as a result of changes in the parameters to be estimated, k and s.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown of which.

DESCRIPTION OF THE INVENTION

Figure 2:
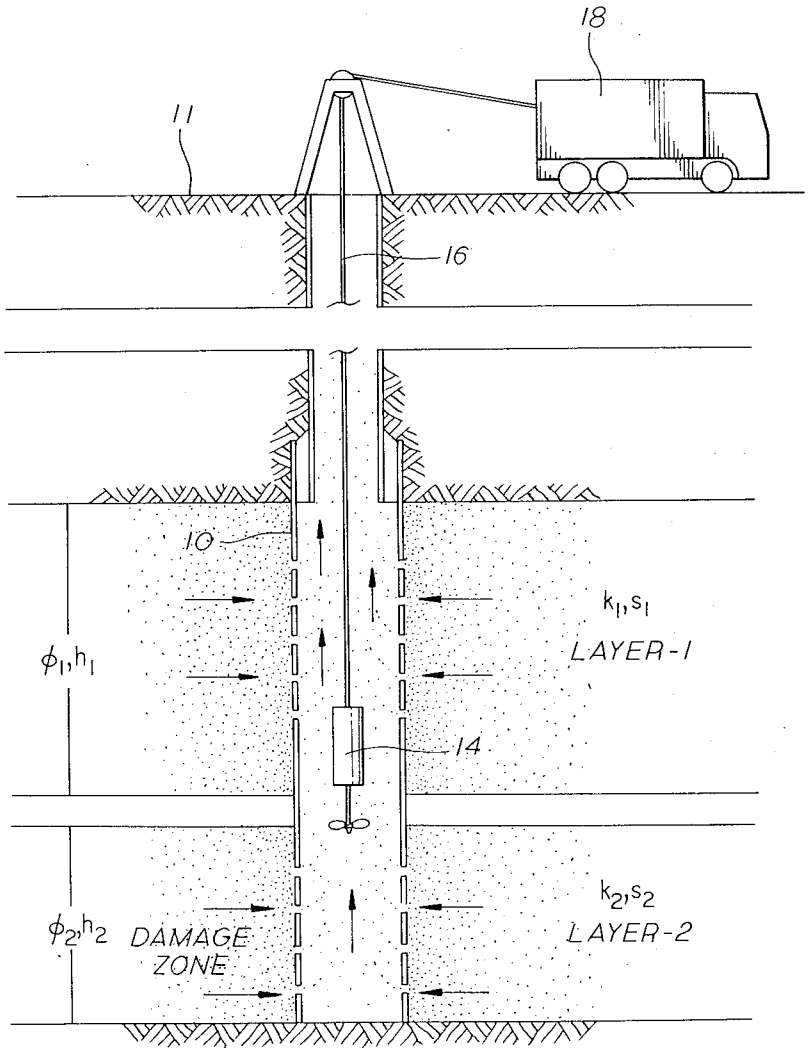
FIG. 2 illustrates the same system and formation as that of FIG. 1 but in which the logging tool of the wireline logging system is disposed at the top of the lower producing zone.
Figure 1:
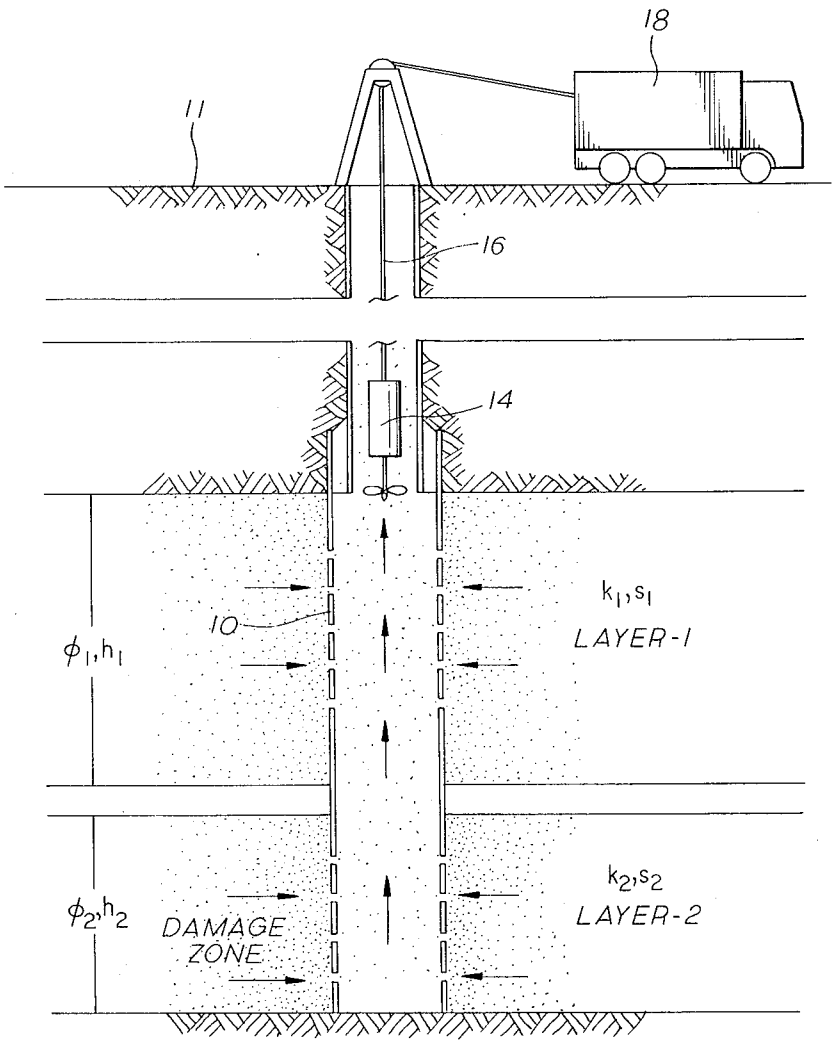
FIG. 1 illustrates schematically a two layer reservoir in which a logging tool of a wireline logging system is disposed at the top of the upper producing zone.

FIGS. 1 and 2 illustrate a two layered reservoir, the parameters of permeability, k, and skin factor, s, of each layer of which are to be determined according to the method of this invention. Although a two-layered reservoir is illustrated and considered, the invention may be used equally advantageously for reservoirs of three or more layers. A description of a mathematical model of the reservoir is presented which is used in the method according to the invention.

MATHEMATICAL MODEL

The reservoir model of FIGS. 1 and 2 consists of two layers that communicate only through the wellbore. Each layer is considered to be infinite in extent with the same initial pressure.

From a practical point of view, it is easy to justify an infinite-acting reservoir if only the data is analyzed that is not affected by the outer boundaries. However, often a differential depletion will develop in layered reservoirs as they are produced. It is possible that each layer may not have the same average pressure before the test. It is also possible that each layer may have different initial pressures when the field is discovered. The method used in this invention is for layers having equal initial pressures, but the method according to the invention may be extended for the unequal initial pressure case.

It is assumed that each layer is homogeneous, isotropic, and horizontal, and that it contains a slightly compressible fluid with a constant compressibility and viscosity.

The Laplace transform of the pressure drop for a well producing at a constant rate in a two-layered infinite reservoir is given by $$\overline{\Delta p}_{sf}(z) = \frac{q_t}{2\pi z\sqrt{z}\sum_{j=1}^{n1}\dfrac{\alpha_j\beta_j K_1(\alpha_j\sqrt{z})}{K_o(\alpha_j\sqrt{z})+s_j\alpha_j\sqrt{z}\,K_1(\alpha_i\sqrt{z})}} \tag{1}$$

where:

$$\alpha_j = \frac{r_{wj}}{\sqrt{\eta_j}}$$

$\eta$ = hydraulic diffusivity $$\beta_j = \left(\frac{kh}{\mu}\right)_j$$

$z$ = Laplace image space variable $n1$ = number of layers = 2

The other symbols are defined in Appendix A at the end of this description where the nomenclature of symbols is defined.

The Laplace transform of the production rate for each layer can be written as:

$$\bar{q}_j = 2\pi\frac{\sqrt{z}\,\alpha_j\beta_j K_1(\alpha_j\sqrt{z})}{[K_o(\alpha_j\sqrt{z})+s_j\alpha_j\sqrt{z}\,K_1(\alpha_i\sqrt{z})]}\Delta p_{sf}(z) \tag{2}$$

$j = 1,2$

Eqs. 1 and 2 give the unsteady-state pressure distribution and individual production rate, respectively, for a well producing at a constant rate in an infinite two-layered reservoir.

For drawdown or buildup tests, Eq. 1 cannot be used directly in the analysis of wellbore pressure because of the wellbore storage (afterflow) effect (unless the semi-log straight line exists). However, most studies on layered reservoirs have essentially investigated the behavior of Eq. 1 for different layer parameters. The principal conclusions of these studies can be outlined as follows:

1. From buildup or drawdown tests, an average flow capacity and skin factor can be estimated for the entire formation.
2. The individual flow capacities can be obtained if the stabilized flow rate from one of the layers is known and if the skin factors are zero or equal to one another.

Estimating layer parameters by means of a optimum test design has been investigated by the prior art using a numerical model similar to that of equation 1 except that skin factors were not included. Such prior art shows that there are serious problems with observability and the question of wellposedness of the parameter estimation for layered reservoirs.

The basic problem of prior art methods for estimating layer parameters is that the pressure data are not sufficient to estimate the properties of layered reservoirs. The invention described here is for a two-step drawdown test with the simultaneously measured wellbore pressure and flow rate data which provides a better estimate for layer parameters than prior art drawdown or buildup tests. Eqs. 1 and 2 will be used to described the behavior of two-layered reservoirs.

WELLBORE PRESSURE BEHAVIOR

Certain aspects of the pressure solution for two-layer systems were discussed in the previous section; basically the constant rate solution was presented. In reality, the highly compressible fluid in the production string will affect this solution. This effect is usually called wellbore storage or afterflow, depending on the test type. It has been a common practice to assume that the fluid compressibility in the production string remains constant during the test. Strictly speaking, this assumption may only be valid for water or water-injection wells. The combined effects of opening or closing the wellhead valve and two-phase flow in the tubing will cause the wellbore storage to vary as a function of time. In many cases, it is difficult to recognize changing wellbore storage because it is a gradual and continuous change. Nevertheless, the constant wellbore storage case is considered here as well.

The convolution integral (Duhamel's theorem) is used to derive solutions from Eq. 1 for time-dependent wellbore (inner boundary) conditions. For example, the constant wellbore storage case is a special time-dependent boundary condition. For a reservoir with an initially constant and uniform pressure distribution, the wellbore pressure drop is given by $$\Delta p_{wf}(t) = \int_0^t q'_D(\tau)\Delta p_{sf}(t-\tau)d\tau \tag{3}$$

$$= \int_0^t q_D(t-\tau)\Delta p'_{sf}(\tau)d\tau + \Delta p_s q_D(t) \tag{3a}$$

where $\Delta p_{wf} = p_i - p_{wf}$ for drawdown tests $\Delta p_{sf} = p_i - p_{sf}$ for drawdown tests $\Delta p_{wf} = p_{ws} - p_{wf}$ for buildup tests $\Delta p_{sf} = p_{sf} - p_{wf}$ for buildup tests $\Delta p_s$ = pressure drop caused by skin $p_{sf}$ = sandface pressure of a well producing at constant rate $q_D(t_D) = q_{sf}(t)/q_t$ $q_{sf}$ = sandface flow rate $q_t$ = reference flow rate $'$ = indicates derivative with respect to time The Laplace transform of $\Delta p_{wf}$ is given by $$\bar{\Delta p}_{wf}(z) = z\bar{\Delta p}_{sf}(z)\bar{q}_D(z) \tag{4}$$

If the wellbore storage is constant, $q_D$ can be expressed as $$q_D = \left(1 + 24C\frac{dp_{wf}}{dt}\right) \tag{5}$$

Substitution of the Laplace transform of Eq. 5 and Eq. 1 in Eq. 4 yields the wellbore pressure solution for the constant wellbore storage case.

Wellbore storage effects for layered reservoirs may be expressed as:

$$q_D = 1 - e^{-\alpha t} \tag{6}$$

where $\alpha$ is dependent on reservoir and wellbore fluid properties.

This condition can be interpreted as a special variable wellbore storage case. It is also possible that for some wells, Eq. 6 describes wellbore storage phenomena far better than Eq. 5. If the sandface rate is measured with available flowmeters, it is not necessary to guess the wellbore storage behavior of a well.

A drawdown test with a periodically varying rate with a different period is considered in order to increase the sensibility of pressure behavior to each layer parameter. This case is expressed as:

$$q_D = [1 - \cos(t/T)]/2 \tag{7}$$

where T = period.

IDENTIFIABILITY OF LAYER PARAMETERS IN WELL TEST ANALYSIS

The problem of identifiability has received considerable attention in history matching by the prior art. The purpose here is to give an identifiability criterion to nonlinear estimation of layer parameters. The identifiability principles given here are very general, and are also applied to other similar reservoir parameter estimations.

The main objective of this section is to estimate layer parameters using the model presented by Eq. 1 and measured wellbore pressure data. For convenience, it is assumed that the measured pressure is free of errors.

Suppose that wellbore pressure, $p^\circ$, is measured m times as a function of time from a two-layered reservoir. It is desired to determine individual layer permeabilities and skin factors from the measured data by minimizing:

$$S(\underline{\beta}) = \frac{1}{2}\sum_{i=1}^{m}[\eta_i(\underline{\beta}, t_i) - p_i^\circ]^2 \tag{8}$$

where $p_i^\circ$ = measured pressure $\eta_i$ = calculated pressure as a function of time, and $\beta$ $\underline{\beta}=(k_1,k_2,s_1,s_2)^T$=parameter vector $k_1,k_2$=permeabilities of first and second layers, respectively $s_1$, $s_2$=skin factors of first and second layers, respectively m=number of measurements Eq. 8 can also be written as:

$$S(\underline{\beta}) = \frac{1}{2}\sum_{i=1}^{m} r_i^2 = \frac{1}{2}\underline{r}^T\underline{r} \tag{9}$$

where $\underline{r}$=m dimensional residual vector

Assume that $\underline{\beta}^*$ is the true solution to Eq. 8. The necessary condition for a unique minimum is:

1. $\underline{g}(\underline{\beta}^*)=0$ and
2. $H(\underline{\beta}^*)$ must be positive definite where g the gradient vector with respect to $\underline{\beta}$ and H is the Hessian matrix of Eq. 8. A positive definite Hessian, also known as the second order condition, ensures that the minimum is unique. Furthermore, without measurement errors, or when the residual is very small, the Hessian can be expressed as:

$$H(\underline{\beta})=A(\underline{\beta})^T A(\underline{\beta}) \tag{10}$$

where A is the sensitivity coefficient matrix with mxn elements $$a_{ij} = \frac{\partial\eta}{\partial\underline{\beta}_j}(\underline{\beta}, t_i)$$

$$i = 1,\ldots,m$$

$$j = 1,\ldots,n$$

The positive definiteness of the Hessian matrix requires that all of the eigenvalues corresponding to the system $$H\underline{v}_j=\lambda \mathrm{hd}\ j^2\underline{v}_j\ j=i,\ldots,n \tag{11}$$

be positive and greater than zero. If an eigenvalue of the Hessian matrix is zero, the functional defined by Eq. 8 does not change along the corresponding eigenvector, and the solution vector $\underline{\beta}^*$ is not unique. Therefore, the number of observable parameters from m measurements can be determined theoretically by examining the rank of the Hessian matrix H, which is equal to the number of nonzero eignevalues.

In the above analysis, it is assumed that the observations are free of any measurement errors. In presence of such errors and limitations related with the pressure gauge resolution, a non-zero cutoff value must be used in estimating the rank of the Hessian. Also, in order to compare parameters with different units, a normalization of the sensitivity coefficient matrix can be carried out by multiplying every column of the sensitivity coefficient matrix by the corresponding nonzero parameter value. That is, $$a_{ij} = \underline{\beta}_j\frac{\partial\eta}{\partial\underline{\beta}_j}\ \underline{\beta}, t_i)$$

$$i = 1,\ldots,m$$

$$j = 1,\ldots,n \tag{12}$$

Furthermore, the largest sensitivity of the functional to parameters is along the eigenvector corresponding to the largest eigenvalue. Each element of the eigenvector $\underline{v}_j$ corresponds to a parameter in the n dimensional parameter space. The magnitude indicates the relative strength of that parameter along the eigenvector $\underline{v}_j$.

NONLINEAR ESTIMATION OF LAYER PARAMETERS FROM CONVENTIONAL TRANSIENT TESTS

In this section an attempt is made to estimate layer parameters by minimizing Eq. 8. The eigenvalue analysis of the sensitivity coefficient is done for four cases.

1. Constant flow rate with no wellbore storage (C=0.0 bbl/psi),
2. Constant flow rate with wellbore storage (C=0.01 bbl/psi),
3. Periodically varying flow rate with a period of 0.1 hours,
4. Periodically varying flow rate with a period of 1 hours.

The pressure data for each case are generated by using Eq. 1 and Eq. 3 with the corresponding $q_D$ solution. Reservoir and fluid data are given in Table 1 for all these cases.

TABLE 1

DATA FOR SEQUENTIAL DRAWDOWN TEST

| Reservoir and Fluid Properties | |
|---|---|
| Initial reservoir pressure, $p_i$, psi | 4400 |
| Wellbore radium, $r_w$, ft | 0.35 |
| Thickness, ft | |
| Layer 1, $h_1$ | 50 |
| Layer 2, $h_2$ | 50 |
| Permeability, md | |
| Layer 1, $k_1$ | 100 |
| Layer 2, $k_2$ | 10 |
| Skin factors | |
| Layer 1, $s_1$ | 5.0 |
| Layer 2, $s_2$ | 10.0 |
| Porosity, fraction | 0.2 |
| Total system compressibility, $c_t$, $psi^{-1}$ | $5 \times 10^{-5}$ |
| Viscosity, $\mu$, cp | 0.8 |
| Formation volume factor, $B_o$, RB/STB | 1.00 |
| First drawdown period, hours | 12.0 |
| Second drawdown period, hours | 12.0 |

The nonlinear least squares Marquardt method with simple constraints is used for the minimization of Eq. 8 with respect to $k_1$, $k_2$, $s_1$, and $s_2$.

Table 2 shows the eigenvalue of the Hessian matrix for each test.

TABLE 2

| Eigenvalue (psi) | Most Sensitive Parameter | Case 1 | Case 2 | Case 3 | Case 4 |
|---|---|---|---|---|---|
| $\lambda_1$ | $k_1$ | 549.3 | 546.2 | 320.5 | 321.9 |
| $\lambda_2$ | $s_1$ | 8.02 | 8.17 | 13.13 | 8.81 |
| $\lambda_3$ | $s_2$ | 0.02 | 0.03 | 0.06 | 0.02 |
| $\lambda_4$ | $k_2$ | 0.005 | 0.005 | 0.011 | 0.001 |

The results of Table 2 clearly indicate that in all cases only two of the eigenvalues are greater than 1 psi. Thus, only two parameters can be uniquely estimated from wellbore pressure data. The largest sensitive parameters are those of the high-permeability layer.

The above analysis has also been done for different combinations of $k_1$, $k_2$, $s_1$, and $s_2$; and the conclusions essentially do not change. The periodical variable rate with 0.1 hours period improves the nonuniqueness problem somewhat. However, the uniqueness problem remains the same for the estimation of $k_1$, $k_2$, $s_1$, and $s_2$ for two-layered reservoirs without crossflow.

The above analysis was also extended to a case with an unknown wellbore storage coefficient can be estimated from wellbore pressure data if it remains constant during the test.

TABLE 3

| EIGENVALUE (psi) | MOST SENSITIVE PARAMETER |
|---|---|
| 546.2 | $k_1$ |
| 12.32 | C |
| 6.4 | $s_1$ |
| 0.017 | $s_2$ |
| 0.005 | $k_2$ |

It is clear from the above discussion that using prior art methods, transient pressure data does not give enough information to determine uniquely flow capacity and skin factor for each individual layer.

NEW TESTING METHODS FOR LAYERED RESERVOIRS

As indicated above, a drawdown test is best suited for two-layered reservoirs without crossflow. Ideally, a reservoir to be tested should be in complete pressure equilibrium (uniform pressure distribution) before a drawdown test. In practice, the complete pressure equilibrium condition cannot be satisfied throughout the reservoir if wells have been producing for some time from the same formation. Nevertheless, the pressure equilibrium condition can easily be obtained in new and exploratory reservoirs.

For developed reservoirs, it is also possible to obtain pressure equilibrium if the well is shut in for a long time. However, in developed layered reservoirs, it is difficult to obtain pressure equilibrium within the drainage area of a well. On the other hand, it is very common to observe pressure differential between the layers.

In addition to these fluid flow characteristics in layered reservoirs, cost and/or operational restrictions can make it impractical to close a well for a long time.

With respect to these different initial conditions, two drawdown test procedures for two-layer reservoirs without crossflow are described according to the invention. Either the initial condition or the stabilized period is important in a given test because during the analysis, the delta pressure ($p-p_{base}$) is used for the estimation of parameters. During the test, it is not crucial to keep the rate constant, since it is measured.

NEW OR SHUT-IN WELLS

The method according to the invention will work well for the wells in a new field or exploratory wells. FIGS. 1 and 2 illustrate a two zone reservoir with a wellbore 10 extending through both layers and to the earth's surface 11. A well logging tool 14 having means for measuring downhole pressure and fluid flow rate communicates via logging cable 16 to a computerized instrumentation and recording unit 18.

As indicated in FIG. 1, the parameters $k_1$, $s_1$ of layer 1 and $k_2$, $s_2$ of layer 2 are desired to be uniquely estimated. One layer, such as layer 2, may have a damaged zone which would result in a high value of $s_2$, skin factor of layer 2, which if known by measurement by the well operator, could aid in decisions relating to curing low flow or pressure from the well.

Figure 3A:
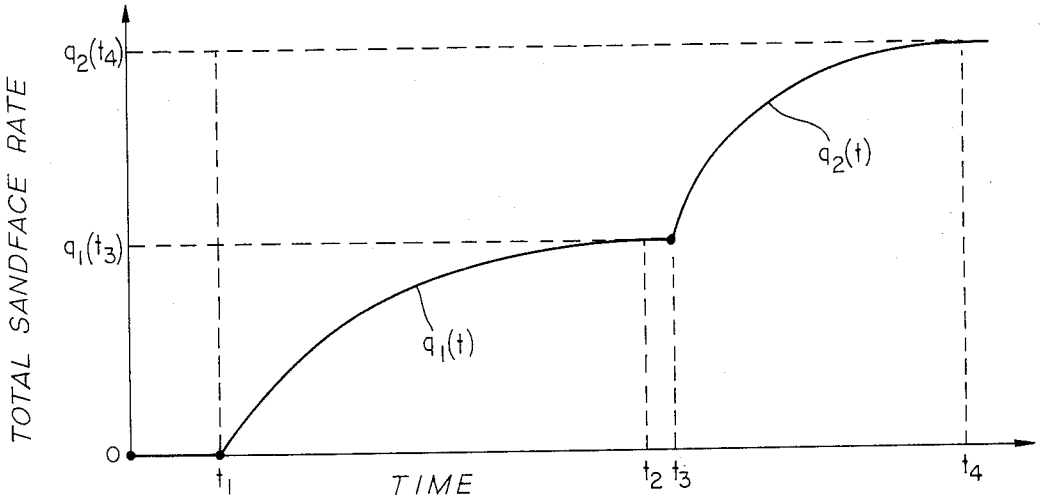
FIG. 3A illustrates the sequential flow rate profile for a new well according to the invention.
Figure 3B:
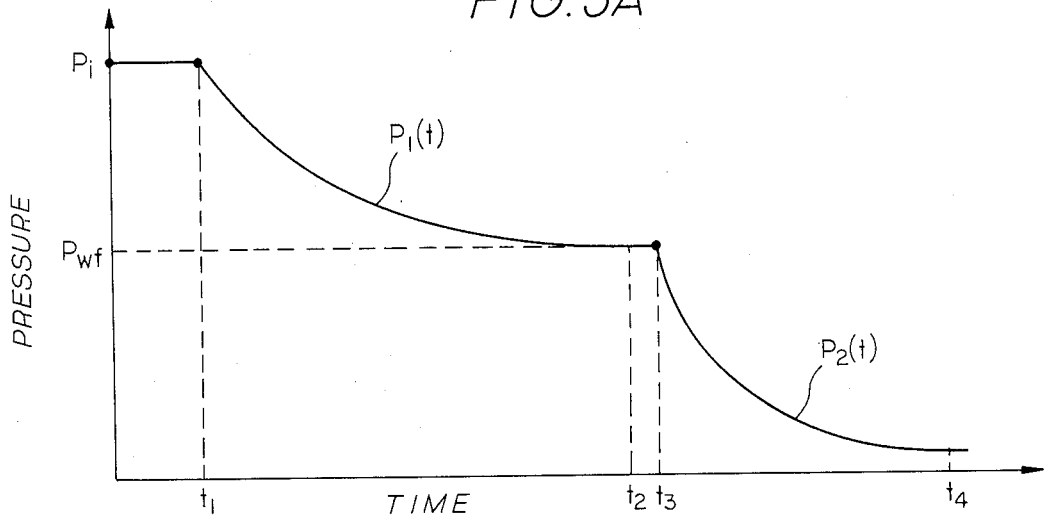
FIG. 3B illustrates the downhole pressure profile which results from the flow rate profile of FIG. 3A.
Figure 7:
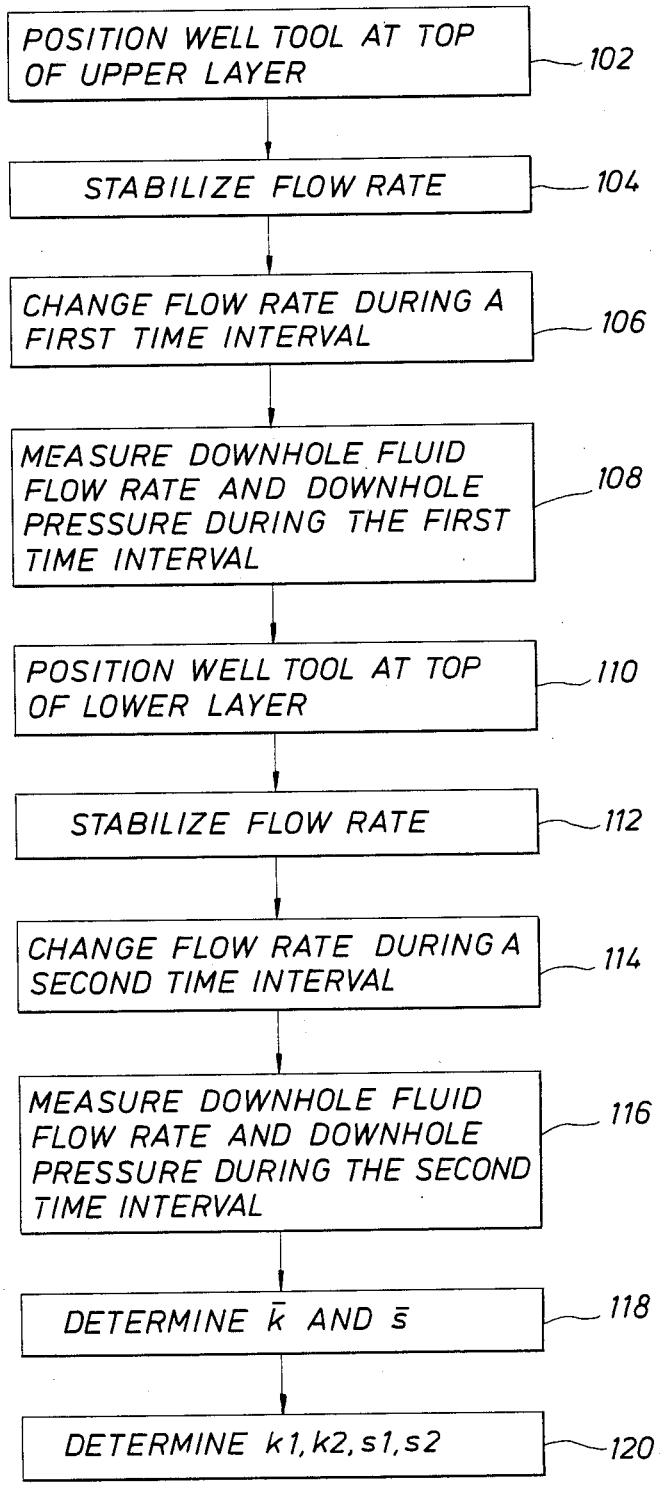
FIG. 7 is a flowchart showing a routine for implementing the invention in a logging system.

For shut-in wells, before starting the test, pressure should be recorded for a reasonable time in order to obtain the rate of pressure decline or to observe a uniform pressure condition in the reservoir. FIG. 3A shows the test procedure graphically, and FIG. 7 represents the corresponding routine for the logging system. First the well tool 14 of FIG. 1 should be positioned just above both producing layers. This is represented in FIG. 7 at a step 102. At time $t_1$, the well should be started to produce at a constant rate at the surface, if possible. This is represented in FIG. 7 at a step 104. Although production rate does not affect the analysis, a rapid rate increase can cause problems. A few of these are:

1. Wellbore fluid momentum effect,
2. Non-Darcy flow around the wellbore, and
3. Two-phase flow at the bottom of the well.

The third problem, which is the most important one, can be avoided by monitoring the flowing wellbore pressure and adjusting the rate accordingly. These three complicating factors should be avoided for all the transient tests, if possible.

During the first drawdown, when an infinite acting (without storage effect) period is reached approximately, the test is continued a few more hours depending on the size of the drainage area. This is represented in FIG. 7 at steps 106 and 108.

Next, the well tool 14 is lowered to the top of the lower zone as illustrated in FIG. 2 while monitoring measured flow rate and pressure. This is represented in FIG. 7 at a step 110. If there is a recordable rate from this layer, at time $t_2$, the production rate should be changed to another rate. The rate can be increased or decreased according to the threshold value of the flowmeter and the bubble point pressure of the reservoir fluid. As can be seen in FIG. 3A, the flow rate is increased. If the rate is not recordable the test is terminated. A buildup test for further interpretation as a single-layered reservoir could be performed.

If the rate is stabilized, as indicated in a step 112, and recordable, the drawdown test should be continued from $t_3$ to $t_4$ for another few hours until another storage-free infinite acting period is reached. This is represented at steps 114 and 116. The test can be terminated at time $t_4$. The interpretation of measured rate and pressure data is discussed below after the test for a producing or short shut-in well is described. This is represented at steps 118 and 120.

PRODUCING OR SHORT SHUT-IN WELLS

Figure 4A:
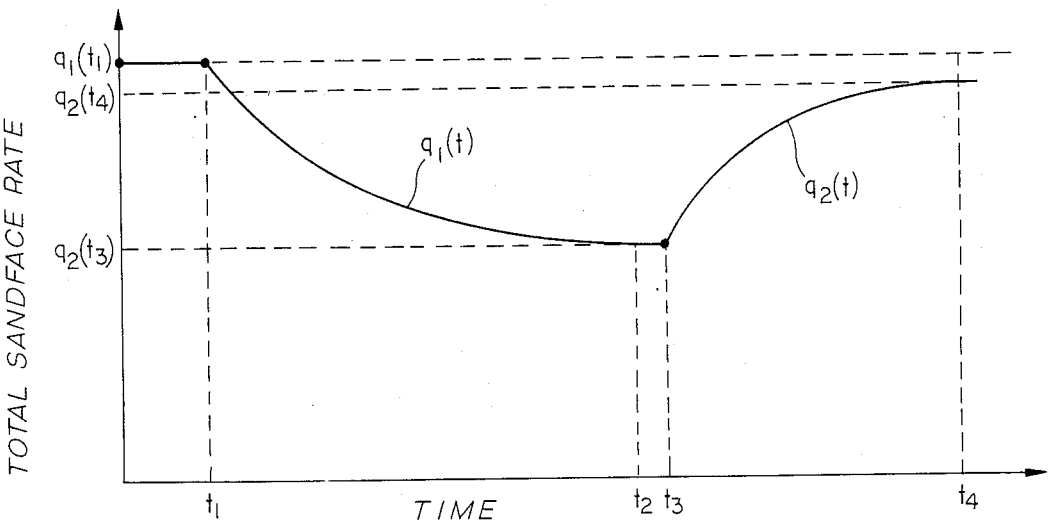
FIG. 4A illustrates the sequential flow rate profile for a producing well according to the invention.
Figure 4B:
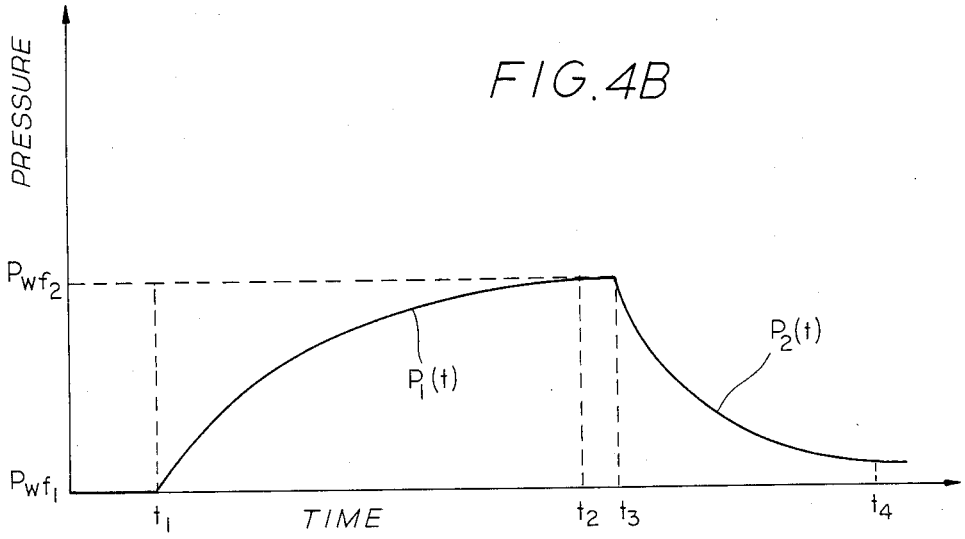
FIG. 4B illustrates the downhole pressure profile which results the flow rate profile of FIG. 4A.

If the well is already producing at a stabilized rate, a short flow profile (production logging) test should be conducted to check if the bottom layer is producing. If there is enough production from the bottom layer to be detected, than as in FIG. 1, the production logging tool 14 is returned to the top of the whole producing reservoir and the test is started by decreasing the flow rate, $q_1(t_1)$, as in FIG. 4A to another rate, $q_1(t_2)$. The well is allowed to continue flowing until time $t_2$, when the well reaches the storage-free infinite acting period. At the end of this period, the tool string should be lowered just to the top of the bottom layer as in FIG. 2. At the time $t_3$, the flow rate is increased back to approximately $q_1(t_1)$. During the test, the rates should be kept above the threshold value of the flowmeter, and wellbore pressure should be kept above the bubble point pressure of the reservoir fluid.

If the test precedes a short shut-in, the procedure will be the same, but the interpretation will be slightly different.

The test procedure described above is applicable for a layer system in which the lower zone permeability is less than the upper zone. If the upper zone is less permeable, then the testing sequence should be changed accordingly.

ANALYSIS OF SEQUENTIAL DRAWDOWN TEST

In this section, the method according to the invention is described to estimate individual layer parameters from measured wellbore pressure and sandface rate data. The automatic type-curve (history) matching techniques are used to estimate $k_1$, $k_2$, $s_1$, and $s_2$. In other words, Eq. 8 is minimized with respect to parameters $k_1$, $k_2$, $s_1$ and $s_2$. An automatic type-curve matching method is described in Appendix B to this description of the invention. Unlike the semilog method, the automatic type curve matching usually fits early time data as well as the storage-free infinite acting period if it exists to a given model.

ANALYSIS OF THE FIRST DRAWDOWN TEST

Figure 5:
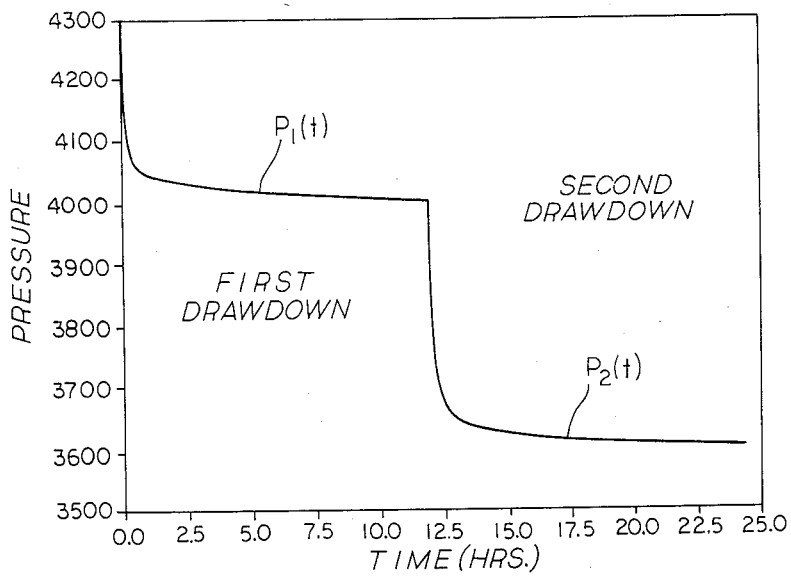
FIG. 5 is a graph of measured downhole pressure as a function of time of a synthetic drawdown test according to the invention.
Figure 6:
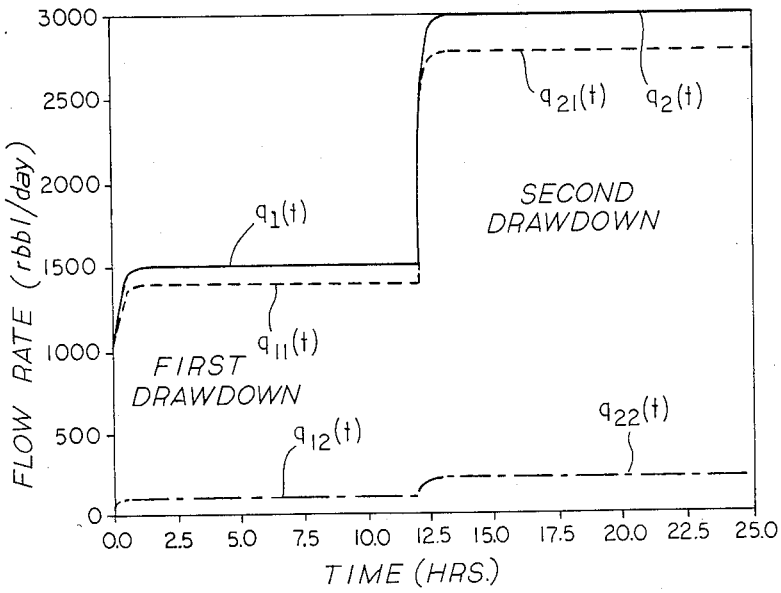
FIG. 6 is a graph of measured downhole flow rates as a function of time of a synthetic drawdown test corresponding to the measured pressure of FIG. 5.

FIG. 5 presents the wellbore pressure data for synthetic sequential drawdown tests, and FIG. 6 presents sandface flow rate data for the same test using the reservoir and fluid data given in Table 1. As can be seen from FIG. 6, the test is started from the initial conditions and the well continues to produce 1,500 bbl/day for 12 hours. For the second drawdown, the rate is increased from 1,500 bbl/day to 3,000 bbl/day. FIG. 6 shows the total and individual flow rates from each zone. In an actual test, during the first drawdown, only total flow rate, $q_1(t)$, will be measured. During the second drawdown, only the rate from the bottom zone will be measured. It is also important to record the flow rate from the lower layer for a few minutes just before the second drawdown test.

The automatic type-curve matching approach is suitable for this purpose. If it is applicable, the semilog portion of the pressure data should also be analyzed. In general, type-curve matching with the wellbore pressure and sandface rate is rather straightforward. A brief mathematical description of the automatic type-curve matching procedure is given in Appendix B. In any case, the automatic type-curve method that is used fits the first drawdown data to a single layered, homogeneous model. The estimated values of $\bar{k}$ and $\bar{s}$ are $\bar{k}=54.69$ md $\bar{s}=5.51$ where $$\bar{k}=(k_1h_1+k_2h_2)/h_t \tag{13}$$

$$h_t=h_1+h_2$$

$$\bar{s}=(q_{11}s_1+q_{12}s_2)/q_1 \tag{14}$$

At the end of the first drawdown test, the rate from the bottom layer, $q_{12}$, should also be measured before starting the second drawdown test.

Strictly speaking, from the first test, $k_1$, $k_2$, $s_1$, and $s_2$ can be calculated by using deconvolution methods. However, the deconvolution process is very sensitive to measurement errors, particularly errors in flow rate measurements. On the other hand, the convolution process, Eq. 3 is a smoothing operation, and it is less sensitive to measurement errors. Thus, the second drawdown test described below almost assures an accurate estimation of the layer parameters. Furthermore, the second transient creates enough sensitivity to the parameters of the less permeable layer.

ANALYSIS OF THE SECOND DRAWDOWN TEST

During this test, the wellbore pressure for the whole system and flow rate for the bottom layer are measured. FIGS. 5 and 6 present wellbore pressure and rate data respectively for the second as well as the first drawdown. These data are analyzed using the automatic type-curve matching method described above.

To estimate $k_2$ and $s_2$ from measured wellbore pressure and sandface rate data, the following equation is minimized:

$$S(\underline{\beta}) = \tfrac{1}{2}\sum_{i=1}^{m} [\eta_i(\underline{\beta}, t_i) - q^o_{22i}(t_i)]^2 \tag{15}$$

where $\underline{\beta}=[k_2,s_2]$ $q_{22i}^o(t_i)$ = measured sandface rate data from the bottom layer $\eta_i(\beta,t_i)$ = computed sandface rate for the bottom layer Two different methods can be used for the minimization of Eq. 15.

FIRST METHOD

The computed sandface rate of the bottom layer for a variable total rate can be expressed as:

$$\eta(\underline{\beta},t) = \int_0^t f(\tau)\Delta p'_{wf}(t-\tau)d\tau \tag{16}$$

In Eq. 2, $\Delta p_{wf}$ is the measured wellbore pressure during the second drawdown. The Laplace transform of f(t) function in Eq. 16 can be expressed as (from Eq. 2):

$$\bar{f}(z) = 2\pi\frac{1}{\sqrt{z}}\;\frac{\alpha_2\beta_2K_1(\alpha_2\sqrt{z})}{[K_o(\alpha_2\sqrt{z}) + s_2\alpha_2\sqrt{z}\;K_1(\alpha_2\sqrt{z})]} \tag{17}$$

The function $\bar{f}(z)$ in Eq. 17 is only a function of the lower layer parameters, $k_2$ and $s_2$. From the convolution of f(t) and $\Delta p_{wf}(t)$, $\eta(\underline{\beta},t)$ can be obtained by automatic type-curve matching. Thus, using $\eta(\beta,t)$ and measured $q_{22}(t)$, Eq. 15 is used to estimate $k_2$ and $s_2$. The estimated values are:

$k_2=8.4$ md $s_2=7.7$

These estimated values of $k_2$ and $s_2$ are somewhat lower than the actual values ($k_2=10$ and $s_2=10$) which raises the question of whether or not Eq. 16 is indeed a correct solution. The direct solution of Eq. 16 gives correct values of the sandface flow rate for the constant wellbore storage case.

The $\bar{f}(z)$ function is the Laplace transform of the dimensionless rate, $q_D$, for a well producing a constant pressure in an infinite radial reservoir. The flow rate $q_D$ changes very slowly with time. In other words, f(t) is not very sensitive to change in $k_2$ and $s_2$. This ill-posedness becomes worse if the sandface rate is not accurately measured at very early times. Thus, an alternate approach for the estimation of $k_2$ and $s_2$ is used to produce a more accurate estimate.

SECOND METHOD

Eq. 16 can also be expressed as:

$$\eta(\underline{\beta},t) = \int_0^t f(\tau) \int_0^{t-\tau} q_D'(\xi)\Delta p_{sf}(\tau - \xi)d\xi d\tau \tag{18}$$

where $q_D' = q_{sf}/q_t$ = total normalized rate, and $\Delta p_{sf}$ is defined by Eq. 1.

In order to compute $\eta(\underline{\beta},t)$, the total rate, $q_D$, must be measured. The total rate cannot be measured unless two flowmeters are used simultaneously. This is not practical using currently available logging tools. Thus, $q_D$ must be determined independently. This is not difficult since during the first drawdown, the behavior of the wellbore storage is known. The sandface flow rate can either be approximated by Eq. 5 or 6 or any other form. It is also important to measure total flow rate just at the end of the second drawdown test. If the wellbore storage is constant, the problem becomes easier. The Laplace transform of $\eta(\underline{\beta},t)$ can be written from Eq. 18 as, $$\bar{\eta}(\underline{\beta},z) = 2\pi \frac{\sqrt{z}\ \alpha_2\beta_2 K_1(\alpha_2\sqrt{z})}{[K_o(\alpha_2\sqrt{z}) + s_2\alpha_2\sqrt{z}\ K_1(\alpha_2\sqrt{z})]} \frac{q_t}{[Cz^2 + 2\pi z\sqrt{z}\sum_{j=1}^{nl} \frac{\alpha_j\beta_j K_1(\alpha_j\sqrt{z})}{K_o(\alpha_j\sqrt{z}) + s_j\alpha_i\sqrt{z}\ K_1(\alpha_i\sqrt{z})}} \tag{19}$$

C = wellbore storage constant

Since $\bar{k}$ and $\bar{s}$ are known from the first test, $k_2$ and $s_2$ can be estimated by minimizing Eq. 15 with respect to measured rate, $q_{22}(t)$, and calculated rate, $\eta(\underline{\beta}, t)$, from Eq. 19.

For the test data presented by FIGS. 5 and 6, the estimated $k_2$ and $s_2$ are:

$k_2 = 10.5$ and $s_2 = 10.8$

These values are very close to the actual values. The eigenvalues for $k_2$ and $s_2$ are $\lambda_1 = 3244$ psia and $\lambda_2 = 3771$ psia, respectively. As can be seen from these two eigenvalues, the sensitivity of each parameter to the model and the measurement is very high.

Because no a priori information is assumed about the wellbore storage behavior during the analysis of the second drawdown, the first method can be used to estimate the lower limit of $k_2$ and $s_2$ in order to check the values calculated from the second method.

Thus there has been provided according to the invention a method for testing a well to estimate individual permeabilities and skin factors of layered reservoirs. A novel two-step sequential drawdown method for layered reservoirs has been provided. The invention provides unique estimates of layer parameters from simultaneously measured wellbore and sandface flow rate data which are sequentially acquired from both layers. The invention provides unique estimates of the parameters distinguished from prior art drawdown or buildup tests using only wellbore pressure data.

The invention uses in its estimation steps the nonlinear least—squares (Marquardt) method to estimate layer parameters from simultaneously measured wellbore pressure and sandface flow rate data. A general criterion is used for the quantitative analysis of the uniqueness of estimated parameters. The criterion can be applied to automatic type-curve matching techniques.

The new testing and estimation techniques according to the invention can be extended to multilayered reservoirs. In principle, one drawdown test per layer should be done for multilayered reservoirs. During each drawdown test, the wellbore pressure and the sandface rate should be measured simultaneously.

The new testing technique can be generalized straightforwardly to layered reservoirs with crossflow.

The testing method according to the invention also can be used to estimate skin factors for each perforated interval of a well in a single layer reservoir. FIG. 7 is applicable to this aspect of the invention.

If the initial pressures of each layer are different, the analysis technique has to be slightly modified. For new wells, the initial pressure of each layer can be obtained easily from wireline formation testers.

Nonlinear parameter estimation methods used in the testing method according to the invention provides a means to determine the degree of uncertainty of the estimated parameters as a function of the number of measurements as well as the number of parameters to be estimated for a given model. Prior art graphical type-curve methods cannot provide quantitative measures to the "matching" with respect to the quality of the measured data and the uniqueness of the number of parameters estimated.

APPENDIX A

NOMENCLATURE

A = sensitivity matrix
$A^T$ = transpose of matrix A
a = element of matrix A
C = wellbore storage coefficient, $cm^3/atm$
$c_t$ = system total compressibility, $atm^{-1}$
Ei(−x) = exponential integral
g = gradient vector
h = layer thickness, cm
$\bar{h}$ = average thickness of a layered reservoir, cm
H = Hessian matrix
$K_o$ = modified Bessel function of the second kind and order zero
$K_1$ = modified Bessel function of the second kind and order one
k = permeability, darcy
$\bar{k}$ = average permeability, darcy
m = number of data points
nl = number of layers in a stratified system
p = pressure, atm
$p_{wf}$ = flowing bottomhole pressure, atm
q = production rate, $cm^3/s$
$q_{sf}$ = sandface production rate $cm^3/s$
$q_t$ = total bottomhole flow rate, $cm^3/s$
r = radial distance, cm
$\bar{r}$ = residual vector
$r_w$ = wellbore radius, cm
s = skin factor, dimensionless
$\bar{s}$ = average skin factor of multilayer systems
S = sum of the squares of the residuals in the least-squares method
t = time, second
v = eigenvector
z = Laplace image space variable Greek Symbols $\alpha = r_w/\sqrt{\eta_j s^{\frac{1}{2}}}$
$\beta = kh/\mu$ = transmissability, darcy·cm/cp
$\underline{\beta}$ = parameter vector
$\underline{\beta}^*$ = estimate of parameter vector $\underline{\beta}$
$\Delta$ = difference
$\eta = k/\phi\mu c$ = hydraulic diffusivity, $c^2/s$
$\eta$ = computed dependent variable
$\lambda$ = eigenvalue
$\phi$ = reservoir porosity, fraction
$\mu$ = reservoir fluid viscosity, cp
$\tau$ = dummy integration variable
$\xi$ = dummy integration variable

SUBSCRIPTS AND SUPERSCRIPTS

D = dimensionless
j = layer number in a multilayer system
sf = sandface
w = wellbore
wf = flowing wellbore
— = Laplace transform of
' = derivative with respect to time

APPENDIX B

Type-Curve Matching Sandface Flow Rate

Eq. 3 can be discretized as:

$$\Delta p_{wf}(t_{n+1}) = \sum_{i=o}^{n} \int_{t_i}^{t_{i+1}} q_D'(t_{n+1} - \tau)\Delta p_{sf}(\tau)d\tau \quad \text{(A-1)}$$

The integral in Eq. A-1 can be approximated from step $t_1$ to $t_{i+1}$ as $$\int_{t_i}^{t_{i+1}} q_D'(t_{n+1} - \tau)\Delta p_{sf}(\tau)d\tau = \Delta p_{sf}(t_{i+\frac{1}{2}}) \int_{t_i}^{t_{1+1}} q_D'(t_{n+1} - \tau)d\tau \quad \text{(A-2)}$$

The right-hand side of Eq. A-2 can be integrated directly. Substitution of the integration results in Eq. 3 yields $$\Delta p_{wf}(t_{n+1}) = \Delta p_{sf}(t_{n+\frac{1}{2}})q_D(t_{n+1} - \tau) + \text{sum} \quad \text{(A-3)}$$

where $$\text{sum} = \sum_{i=o}^{n-1} \Delta p_{sf}(t_{i+\frac{1}{2}})[q_D(t_{n+1} - \tau) - q_D(t_{n+1} - \tau_{i+1})] \quad \text{(A-4)}$$

and the first term in Eq. A-4 is given by $$\Delta p_{wf}(t_1) = \Delta p_{sf}(t_{\frac{1}{2}})q_D(t_1) \quad \text{(A-5)}$$

In Eqs. A-3 to A-5, $q_D$ is normalized measured sandface rate defined as $$q_D(t) = q_{sf}(t)/q \quad \text{(A-6)}$$

For type-curve matching the $\Delta p_{sf}$ is model dependent. For a homogeneous single-layer system, $\Delta p_{sf}$ is given by $$\Delta p_{sf}(t) = -\frac{\mu q}{2\pi kh} Ei\left(-\frac{\phi\mu c_t r_w}{4kt}\right) + s \quad \text{(A-7)}$$

The cylindrical source solution can also be used instead of the line source solution that is given by Eq. A-7. However, the difference between the two solutions is very small. Furthermore, for the minimization of Eq. 8, many function evaluations may be needed. Thus, Eq. A-7 will be used. If the Laplace transform solution is used, the minimization becomes very costly because for a given time, at least 8 function evaluations have to be made in order to obtain $\Delta p_{sf}(t)$.

In Eq. A-3, the time step is fixed by the sampling rate of the measured data. It is preferred for the integration that the data sampling rate be less than 0.1 hours; i.e., $t_i - t_{i-1} < 0.1$ hours.

In order to estimate k and s from measured wellbore pressure and sandface flow rate data, Eq. 8 is minimized. Eq. 8 can be written as $$S(\underline{\beta}) = \tfrac{1}{2} \sum_{i=1}^{m} [\eta_i(\underline{\beta}, t_i) - p_i^o(t_1)]^2 \quad \text{(A-8)}$$

where $\underline{\beta} = [k, s]^T$
$\eta(\underline{\beta}, t_i) = \Delta p_{wf}(t_i)$ in Eq. (A-3)
$p_i^o(t_i)$ = the measured wellbore pressure As mentioned earlier, $S(\underline{\beta})$ is minimized by using the Marquardt method with simple constraints.

In the case of two-layered reservoirs, Eq. 1 should be used for $\Delta p_{sf}(t)$ instead of Eq. A-7.

What is claimed is:

1. A well test method for estimating the permeability and skin factor of two layers in a reservoir comprising the steps of:

(1) positioning a logging tool in a first position at the top of the first layer of the reservoir;
(2) changing the surface flow rate of the reservoir;
(3) measuring both the downhole fluid flow rate of the reservoir and pressure at said logging tool as a function of time;
(4) positioning said logging tool in a second position at the top of the second layer of the reservoir;
(5) repeating steps 2 and 3; and
(6) combining said measured fluid flow rates and pressures to estimate the permeability and skin factor of said layers.

2. The method of claim 1 wherein the well test method is for a flowing well and the surface flow rate is decreased from a non-zero flow rate to a stabilized flow rate.

3. The method of claim 1 wherein said downhole fluid flow rate is measured at two stabilized flow rates while said logging tool is in said first position and at two stabilized flow rates while said logging tool is in said second position.

4. A well test method for estimating the permeability and skin factor of a formation having an upper layer and a lower layer in a reservoir comprising the steps of:

changing the surface flow rate from an initial rate, and after such surface flow rate reaches a first steady state condition;

measuring and recording both the downhole fluid flow rate $q_1$ and the downhole pressure $p_1$ at the top of the upper layer of the formation;

changing the surface flow rate to a second steady state condition;

measuring and recording both the downhole fluid flow rate $q_2$ and pressure $p_2$ at the top of the lower layer of the formation while said surface flow rate is at said second steady state condition;

determining from said flow rate $q_2$ and pressure $p_2$ measurements of said lower layer the permeability $k_2$ and skin factor $s_2$ of the lower layer; and determining the permeability $k_1$ and $s_1$ of the upper layer from said flow rate $q_1$ and pressure measurement $p_1$ of said upper layer and said permeability $k_2$ and skin factor $s_2$ of the lower layer.

* * * * *